US009360206B2

(12) United States Patent
Hiss et al.

(10) Patent No.: US 9,360,206 B2
(45) Date of Patent: Jun. 7, 2016

(54) ILLUMINATION SYSTEM FOR PERCUSSION INSTRUMENTS

(71) Applicant: Grover Musical Products, Inc.

(72) Inventors: Ronald Hiss, Cleveland, OH (US); Cory Berger, Cleveland, OH (US)

(73) Assignee: Grover Musical Products, Inc., Cleveland, OH (US)

( * ) Notice: Subject to any disclaimer, the term of this patent is extended or adjusted under 35 U.S.C. 154(b) by 0 days.

(21) Appl. No.: 14/517,322

(22) Filed: Oct. 17, 2014

(65) Prior Publication Data

US 2015/0114207 A1 Apr. 30, 2015

Related U.S. Application Data

(60) Provisional application No. 61/895,121, filed on Oct. 24, 2013.

(51) Int. Cl.

| | |
|---|---|
| ***A63J 17/00*** | (2006.01) |
| ***F21V 33/00*** | (2006.01) |
| ***F21V 23/04*** | (2006.01) |
| ***G10D 13/00*** | (2006.01) |
| ***G10G 7/00*** | (2006.01) |
| *F21S 9/02* | (2006.01) |
| *F21Y 101/02* | (2006.01) |
| *F21Y 113/00* | (2016.01) |

(52) U.S. Cl.

CPC ..... *F21V 33/0056* (2013.01); *F21V 23/0442* (2013.01); *G10D 13/00* (2013.01); *G10G 7/00* (2013.01); *F21S 9/02* (2013.01); *F21V 23/0471* (2013.01); *F21V 23/0492* (2013.01); *F21Y 2101/02* (2013.01); *F21Y 2113/005* (2013.01)

(58) Field of Classification Search

CPC ..... G10D 13/02; G10D 13/06; G10D 13/00; A63J 17/00; G10G 7/00; F21V 33/0056

See application file for complete search history.

(56) References Cited

U.S. PATENT DOCUMENTS 1,728,860 A * 9/1929 Burnett ..... 84/464 R
1,913,233 A * 6/1933 De Francesco ..... 84/464 R (Continued)

FOREIGN PATENT DOCUMENTS

CA 2617371 A1 7/2008
WO 8702168 4/1987

(Continued)

OTHER PUBLICATIONS

Reactorz Percussion Worldwide, retrieved on Jun. 10, 2013 from http://www.reactorzpercussion.com/Productsilluminerseries-us.html, 1 page.

(Continued)

*Primary Examiner* — Robert W Horn

(74) *Attorney, Agent, or Firm* — Hahn Loeser & Parks, LLP

(57) ABSTRACT

An illumination system and method for percussion instruments is disclosed. The system comprising of housing, one or more sensors, one or more light sources controlled by said sensors, and a power source to operate the illumination system. Said sensors and said light sources are self-contained within said housing. Also, the system further comprises a means for supporting said illumination system in close proximity to a striking surface of said percussion instruments.

18 Claims, 9 Drawing Sheets

(56) References Cited

U.S. PATENT DOCUMENTS

| | | | | | |
|---|---|---|---|---|---|
| 2,849,819 | A * | 9/1958 | Murphy et al. | 446/153 |
| 3,018,683 | A * | 1/1962 | Way | 84/464 R |
| 3,240,099 | A * | 3/1966 | Irons | 84/464 R |
| 3,346,732 | A * | 10/1967 | Crusius | 362/86 |
| 3,540,343 | A * | 11/1970 | Rifkin | 84/464 R |
| 3,719,857 | A * | 3/1973 | Sharp | 315/156 |
| 3,845,468 | A * | 10/1974 | Smith | 84/464 R |
| 4,091,706 | A * | 5/1978 | Ludwig | 84/411 R |
| 4,164,823 | A * | 8/1979 | Marsico | 40/427 |
| 4,353,008 | A * | 10/1982 | Dorfman | 315/114 |
| 4,358,754 | A * | 11/1982 | Young et al. | 340/815.46 |
| 4,440,059 | A * | 4/1984 | Hunter | 84/464 R |
| 4,466,596 | A * | 8/1984 | Cohen | 248/635 |
| 4,671,158 | A * | 6/1987 | Saputo | 84/411 M |
| D305,026 | S * | 12/1989 | Wolf | D14/229 |
| 4,917,373 | A * | 4/1990 | Bourne et al. | 472/61 |
| 4,928,568 | A * | 5/1990 | Snavely | 84/464 R |
| 4,939,972 | A * | 7/1990 | Falberg | 84/422.4 |
| 5,056,399 | A * | 10/1991 | Hornstein | 84/464 R |
| 5,136,487 | A | 8/1992 | Schmidt | |
| 5,262,585 | A | 11/1993 | Greene et al. | |
| 5,280,742 | A * | 1/1994 | Vergara | 84/411 R |
| D378,745 | S * | 4/1997 | Hollis | D10/109.1 |
| 5,684,258 | A * | 11/1997 | Liao | 84/421 |
| 5,818,342 | A * | 10/1998 | Solomon et al. | 340/815.46 |
| 5,854,436 | A | 12/1998 | Wernick et al. | |
| 5,922,981 | A * | 7/1999 | Ballister | 84/464 A |
| D417,689 | S * | 12/1999 | Katz | D17/13 |
| D419,247 | S * | 1/2000 | Kessler | D26/1 |
| 6,106,135 | A * | 8/2000 | Zingale et al. | 362/186 |
| 6,222,522 | B1 * | 4/2001 | Mathews et al. | 345/156 |
| 6,369,313 | B2 | 4/2002 | Devecka | |
| 6,570,078 | B2 | 5/2003 | Ludwig | |
| 7,014,581 | B2 * | 3/2006 | Ng | 473/570 |
| 7,207,688 | B2 * | 4/2007 | Yuen et al. | 362/103 |
| 7,227,075 | B2 | 6/2007 | Chang et al. | |
| 7,228,190 | B2 * | 6/2007 | Dowling et al. | 700/94 |
| 7,343,777 | B2 * | 3/2008 | Cordani | 73/12.01 |
| 7,459,623 | B2 * | 12/2008 | Robertson | 84/464 R |
| 7,501,571 | B2 | 3/2009 | Forsman et al. | |
| 7,525,032 | B2 | 4/2009 | Mishima | |
| 7,614,959 | B1 * | 11/2009 | Gentile | 473/131 |
| 7,667,130 | B2 * | 2/2010 | Mishima | 84/723 |
| 7,741,551 | B2 | 6/2010 | Mori | |
| 7,759,569 | B2 | 7/2010 | Poels | |
| 7,851,687 | B2 * | 12/2010 | Chang | F21V 33/0056 84/464 A |
| 8,085,163 | B1 * | 12/2011 | Wells et al. | 340/815.46 |
| 8,168,875 | B2 | 5/2012 | Stockli | |
| 8,254,839 | B2 * | 8/2012 | Hsien | 455/41.2 |
| 8,697,977 | B1 * | 4/2014 | Lysaght et al. | 84/626 |
| 8,723,013 | B2 * | 5/2014 | Tabata | 84/615 |
| 8,729,378 | B2 * | 5/2014 | Ryan et al. | 84/723 |
| 8,759,659 | B2 * | 6/2014 | Tabata | 84/615 |
| 8,801,521 | B2 * | 8/2014 | Haga et al. | 463/37 |
| 8,853,514 | B2 * | 10/2014 | Cox, Jr. | 84/411 R |
| 8,872,015 | B2 * | 10/2014 | Truchsess | 84/723 |
| 8,937,239 | B2 * | 1/2015 | Takasaki et al. | 84/737 |
| 8,940,994 | B2 * | 1/2015 | Truchsess | 84/737 |
| 2004/0154458 | A1 * | 8/2004 | Coleman | 84/470 R |
| 2007/0028746 | A1 * | 2/2007 | Herring | 84/322 |
| 2009/0020659 | A1 * | 1/2009 | Crous | H04R 1/08 248/125.8 |
| 2010/0009746 | A1 * | 1/2010 | Raymond et al. | 463/31 |
| 2011/0197333 | A1 | 8/2011 | Liotta | |
| 2012/0048099 | A1 | 3/2012 | Wissmuller | |
| 2012/0060669 | A1 | 3/2012 | Ryan et al. | |
| 2012/0144980 | A1 * | 6/2012 | Roderick | G10H 3/143 84/723 |
| 2012/0186419 | A1 * | 7/2012 | Roderick | G10H 3/143 84/723 |
| 2013/0047823 | A1 | 2/2013 | Tabata | |
| 2014/0077723 | A1 * | 3/2014 | Ahern | H05B 33/0863 315/299 |
| 2014/0123831 | A1 * | 5/2014 | Dunnett | 84/411 R |
| 2014/0301589 | A1 * | 10/2014 | Greenwood et al. | 381/361 |
| 2015/0009417 | A1 * | 1/2015 | Jargiello, III | 348/789 |
| 2015/0114207 | A1 * | 4/2015 | Hiss et al. | 84/464 R |
| 2015/0143978 | A1 * | 5/2015 | Oh et al. | 84/692 |

FOREIGN PATENT DOCUMENTS

| | | | |
|---|---|---|---|
| WO | 2012037385 | A1 | 3/2012 |
| WO | 2012155460 | A1 | 11/2012 |

OTHER PUBLICATIONS

Drumlite/LED Drum Lighting, retrieved on Oct. 30, 2013 from http://www.iwdrumlite.com, 2 pages.

Pre-made Bass Drum Light Kits, retrieved on Oct. 30, 2013 from http://www.iwdrumlite.com/bass-drum.html, 1 page.

DrumLite Kits for Wood Drums, retrieved on Oct. 30, 2013 from http://www.iwdrumlite.com/wood-drums.html, 1 page.

DrumLite Kits for Acrylic and Hybrid Drums, retrieved on Oct. 30, 2013 from http://www.iwdrumlite.com/acrylic-drums.html, 1 page.

* cited by examiner

ILLUMINATION SYSTEM FOR PERCUSSION INSTRUMENTS

CROSS-REFERENCE TO RELATED APPLICATION

This application claims the benefit of U.S. Provisional Application No. 61/895,121 , filed Oct. 24, 2013.

TECHNICAL FIELD

Certain embodiments of the present invention relate to an illumination system for percussion instruments. More particularly, certain embodiments of the present invention relate to a system and method of illuminating of or by percussion instruments in response to stimuli including vibrations, movements, or sounds produced by percussion instruments.

BACKGROUND OF THE INVENTION

Diverse design changes have been made to the percussion instruments in recent years. To enhance the design, diverse illuminating devices have been combined with percussion instruments. However, prior art illumination systems for percussion instruments have required involved electronics and a system of wires, leads, pickups and sensors. Among other disadvantages, the known systems take up too much space and are inconvenient to move.

Thus, it is desirable to develop an illumination system for percussion instruments that is more convenient to move and attach to the percussion instruments, and thus taking up significantly less space than conventional systems because sensors, light sources, and, optionally, power sources are self-contained within a single housing.

Further limitations and disadvantages of conventional, traditional, and proposed approaches will become apparent to one of skill in the art, through comparison of such systems and methods with the present invention as set forth in the remainder of the present application as set forth with reference to the drawings.

BRIEF SUMMARY OF THE INVENTION

A first embodiment of the present invention provides an illumination system for percussion instruments. The system comprises a housing, one or more sensors, one or more light sources controlled by said sensors, a power source to operate the illumination system, and a means for supporting said illumination system in close proximity to a striking surface of said percussion instruments.

Also, said sensors include at least one from a group of sensors comprising vibration sensors, motion sensors, and sound sensors, each said sensor capable of being activated by vibrations, movements, or sounds produced when the percussion instruments are played. Said sensors and said light sources are self-contained within said housing.

Another embodiment of the present invention comprises a method of controlling the illumination system for percussion instruments. The method comprises of the steps of detecting vibrations, movements, or sounds produced by percussion instruments, generating electrical signals representative of the detected vibrations, movements, or sounds respectively, and illuminating a light by the generated electrical signals.

Another embodiment of the present invention comprises of a method of illuminating the percussion instruments. The method comprises the steps of supporting an illumination device for percussion instruments in proximity of a striking surface of said percussion instruments, activating said illumination device to detect stimuli including vibrations, movements, or sounds produced by said percussion instruments, producing said stimuli in connection with said percussion instruments, and illuminating said percussion instruments by said illumination device in response to said stimuli.

These and other advantages and novel features of the present invention, as well as details of an illustrated embodiment thereof, will be more fully understood from the following description and drawings.

DETAILED DESCRIPTION OF THE INVENTION

Figure 1:
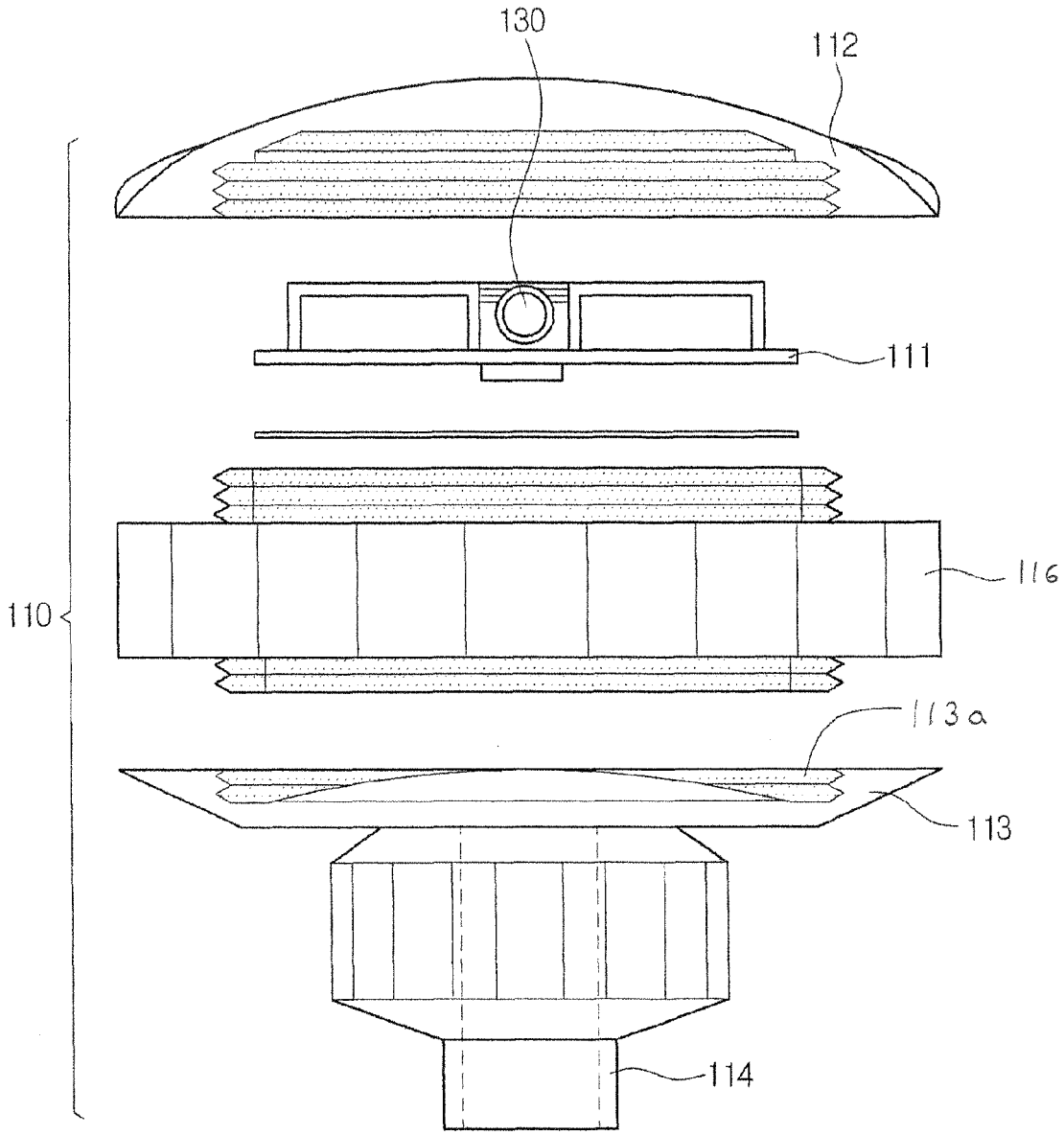
FIG. 1 is a cross-sectional view of a first exemplary embodiment of a system for percussion instruments, in accordance with various aspects of the present invention.
Figure 1A:
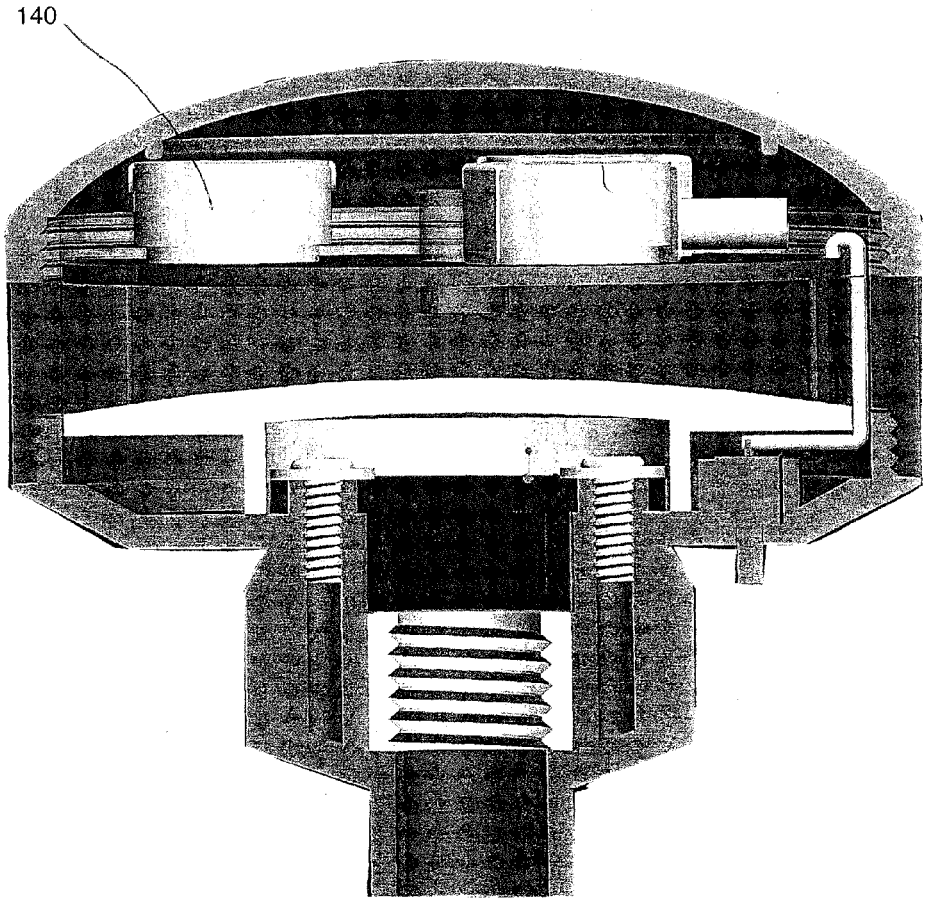
FIG. 1*a* is a further cross-sectional view of a first exemplary embodiment of a system for percussion instruments, in accordance with various aspects of the present invention.
Figure 2:
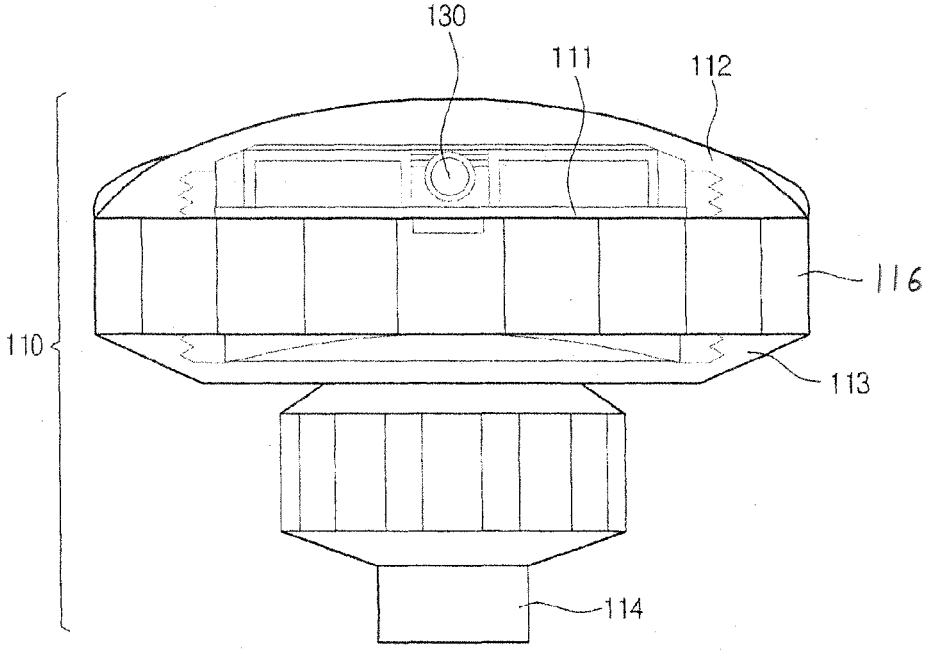
FIG. 2 is a side elevational view with a partial cut-away of a first exemplary embodiment of a system for percussion instruments, in accordance with various aspects of the present invention.
Figure 3:
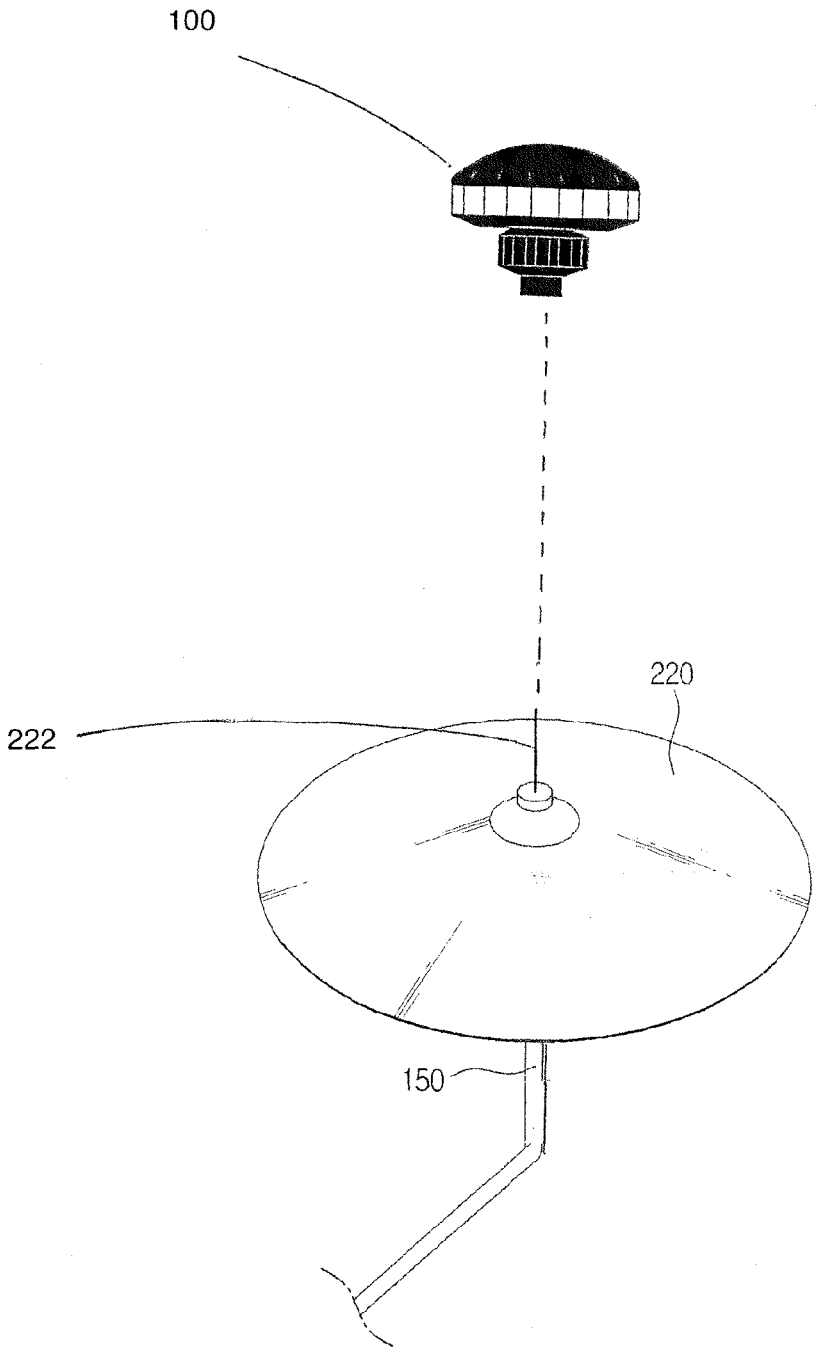
FIG. 3 is an elevational view of a percussion cymbal with a first exemplary embodiment of a system for illumination of percussion instruments attached thereto, in accordance with various aspects of the present invention.
Figure 3A:
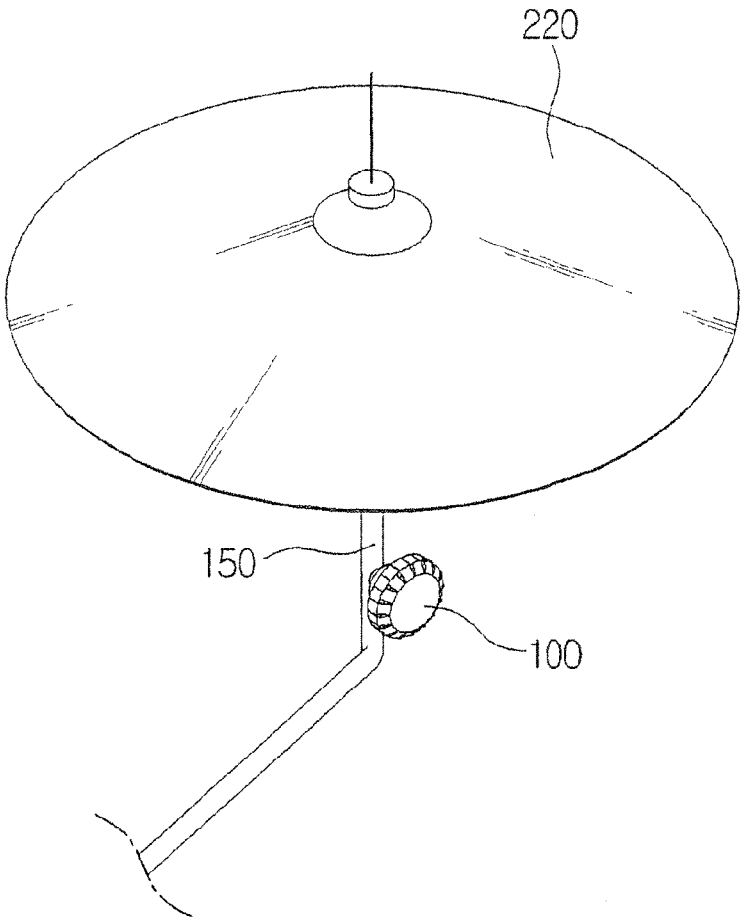
FIG. 3*a* is an elevational view of a percussion cymbal with a first exemplary embodiment of a system for illumination of percussion instruments placed in an alternate location.
Figure 4:
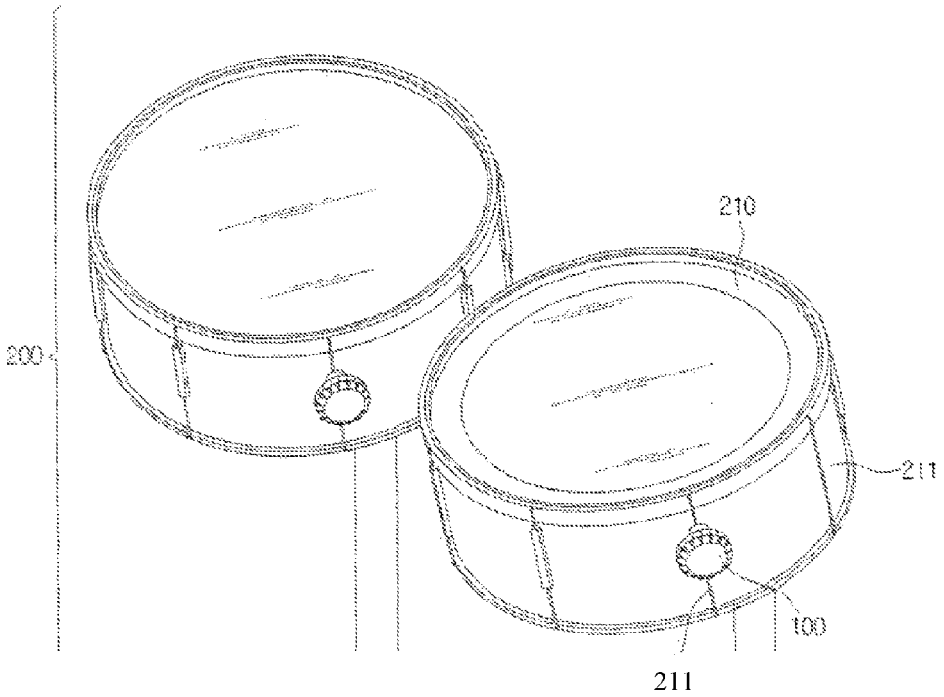
FIG. 4 is a front view diagram of a first exemplary embodiment of a system for percussion instruments, cymbals, in accordance with various aspects of the present invention.

The system 100 comprises a housing 110, one or more sensors 120, one or more light sources 130, and power source 140. The sensors 120 include at least one from a group of sensors consisting of vibration sensors, motion sensors, and sound sensors, each said sensor capable of being activated by respective vibrations, movements, or sounds produced when the percussion instrument in close proximity is played. The sensors 120 and the light sources 130 are self-contained within a housing 110. Thus, the system 100 is portable and easy to install on percussion instruments as illustrated in FIGS. 3, 3*a* and 4. The system 100 further comprises a means 114 for supporting the illumination system 100 in close proximity to a striking surface of said percussion instruments 200. As shown in FIGS. 1 and 1*a* , this is a receiver or throat which can be attached to the terminal end of a cymbal stand 222. In one exemplary embodiment, the cymbal stand contains external threads corresponding to internal threads in housing 110. Many alternate means for attachment in close proximity to the percussion instrument are contemplated, including but not limited to clips, thumb screws, temporary bonding or permanent bonding by adhesives or other bonding agents, mechanical fasteners, welding, brazing, soldering, etc.

In accordance with various embodiments of the present invention, the means 150 may be a stand in proximity to percussion instruments 200 as shown in FIGS. 3, 3*a* and 4. The stand 150 may assist in the support of the corresponding percussion instrument or just support device 100. The percussion instruments 200 comprise at least one of a drum 210 or a cymbal 220. The means 150 may be a clamp capable of attachment to the rim 211 of the drum 210. The means 114 is capable of threaded engagement with a support structure for said cymbal 220 or a support frame associated with the rim 211 of said drum 210.

The light sources 130 are intended to be visible from a distance (i.e. from an audience) and/or to illuminate the percussion instruments. The light sources 130 may comprise lights of different colors. The colors may optionally correspond with a particular instrument or kind of percussion instrument. The light source may be any luminescence device, but a light-emitting diode (LED) is one good choice.

When used, a vibration sensor is activated in response to vibrations produced by the percussion instruments 200. When used, a motion sensor is activated in response to movements produced by players or sticks for the percussion instruments 200. When used, a sound sensor is activated in response to sounds produced by the percussion instruments 200.

A power source 140 may comprise one or more battery cells. In the embodiment shown in FIG. 5, the power source comprises three or four battery cells for effective arrangement of the battery cells on a substrate. Alternately, a power source external to the housing may be used, such as AC or a battery pack connected using wires.

Figure 5:
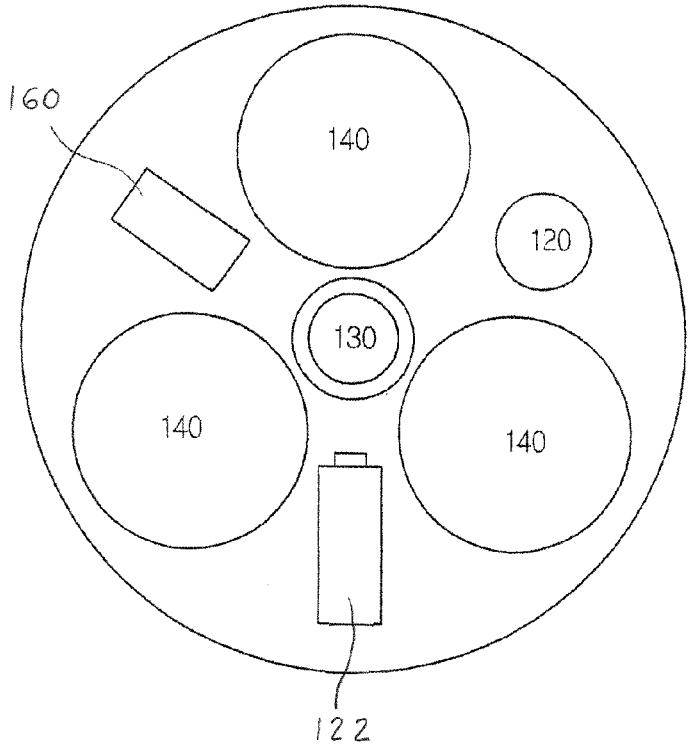
FIG. 5 is a top view diagram of a substrate of a first exemplary embodiment of a system for percussion instruments, in accordance with various aspects of the present invention.

FIG. 5 is a top view diagram of such a substrate of a first exemplary embodiment of a system for percussion instruments, in accordance with various aspects of the present invention.

A substrate 111 is contained within said housing 110. Housing 110 includes at least an upper cover 112 and a lower cover 113. The sensors 120, the light sources 130, an optional capacitor 160 or similar electronic component, and optionally the power source 140 are located with the housing and/or on a substrate 111. The sensors 120 may include a vibration sensor 122. The vibration sensor 122 may be comprised of a first conductive component and a second conductive component held proximate to one another such that percussive vibration may cause intermittent conductive contact therebetween. A vibration sensor 122 may during the striking or playing of an associated percussion instrument provide a conductive path to active the light sources 130. An inner surface 113*a* of said lower cover 113 may be coated by reflective materials, with one example being chrome. In some embodiments, the inner surface 113*a* of said lower cover 113 is not coated by a reflective material.

Locked in the housing, such as within or in between the upper cover 112 or the lower cover 113 is at least one lens 116. Through the lens 116, the light made by the light sources 130 is emitted in general, and/or directed to the percussion instruments 200.

In certain embodiments the lens 116 and the lower cover 113 may be bonded together by adhesive, gluing, heat sealing, ultrasonic welding, or other means.

Figure 6:
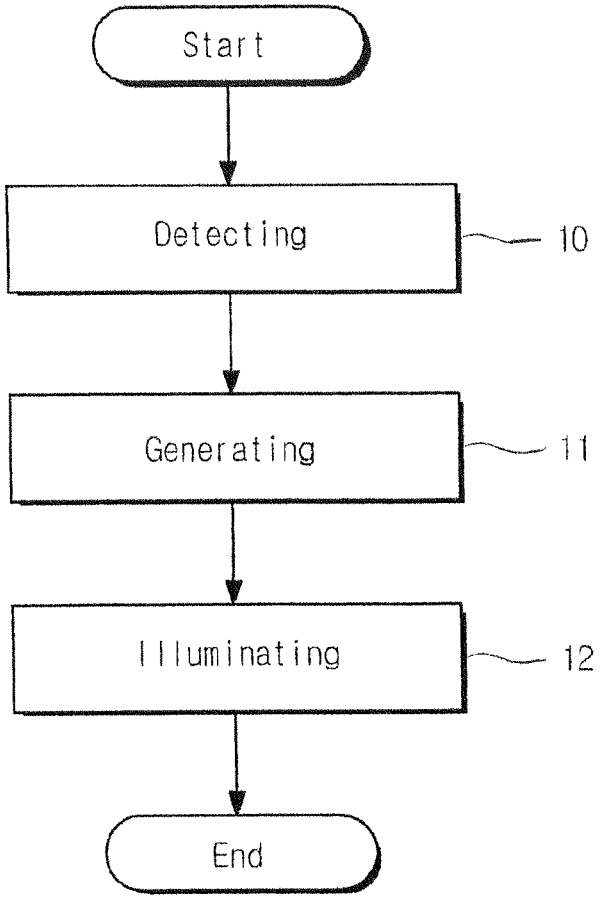
FIG. 6 is a flowchart of a second exemplary embodiment of a method of controlling the system of FIGS. 1 to 5, in accordance with various aspects of the present invention.

FIG. 6 is a flowchart of a second exemplary embodiment of a method of controlling the system of FIGS. 1 to 5, in accordance with various aspects of the present invention.

In step 10, vibrations, movements, or sounds produced by percussion instruments are detected. As noted above, the vibrations, the movements, or the sounds may be detected by sensors, contained within the device. Any number of combinations of sensor types is contemplated and the level of sensitivity for any sensor may be fixed or adjustable.

In step 11, electrical signals representative of the detected vibrations, movements, or sounds, respectively, are generated. The electrical signals may be different according to the level of detected vibrations, movements, or sounds. Also, the light may be illuminated in different colors and brightness according to the electrical signals, respectively.

In step 12, a light is illuminated by the generated electrical signals. The illuminating time may be dependent on the level of detected vibrations, movements, or sounds. In some embodiments, a light may comprise a light-emitting diode.

Figure 7:
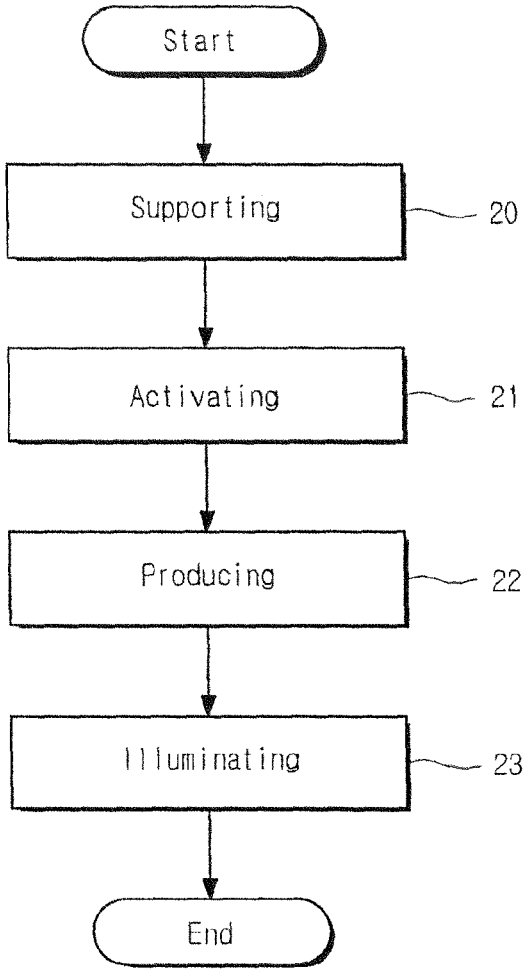
FIG. 7 is a flowchart of a third exemplary embodiment of a method of illuminating percussion instruments using the system of FIGS. 1 to 5, in accordance with various aspects of the present invention.

FIG. 7 is a flowchart of a third exemplary embodiment of a method of illuminating percussion instruments using the system of FIGS. 1 to 5 in accordance with various aspects of the present invention.

In step 20, an illumination device for percussion instruments in proximity to a striking surface of percussion instruments is supported. Said illumination device comprises a housing, one or more sensors, one or more light sources controlled by the sensors, and a power source to operate the illumination system. Said sensors include at least one from a group of sensors consisting of vibration sensors, motion sensors, and sound sensors. Each said sensor is capable of being activated by vibrations, movements, or sounds produced when the percussion instruments are played. Also, said sensors and said light sources are self-contained within said housing.

In step 21, said illumination device to detect stimuli including vibrations, movements, or sounds produced by said percussion instruments is activated. In step 22, said stimuli in connection with said percussion instruments is produced. In step 23, percussion instruments are illuminated by said illumination device in response to said stimuli.

In summary, embodiments of the present subject matter provide an illumination system for and method of illuminating percussion instruments in response to stimuli including vibrations, movements, or sounds produced by percussion instruments. The system comprises a housing, one or more sensors, one or more light sources controlled by said sensors, and a power source to operate the illumination system. Said sensors and said light sources are self-contained within said housing. Also, the system comprises a means for supporting the said illumination system in close proximity to a striking surface of said percussion instruments. As a result, the system is portable and easy to install on percussion instruments.

While the present subject matter has been described with reference to certain embodiments, it will be understood by those skilled in the art that various changes may be made and equivalents may be substituted without departing from the scope of the present subject matter. In addition, many modifications may be made to adapt a particular situation or material to the teachings of the present subject matter without departing from the present scope. Therefore, it is intended that the present subject matter not be limited to the particular embodiments disclosed, but that the present subject matter will include all embodiments falling within the scope of the appended claims.

What is claimed is:

1. An apparatus for use with percussion instruments comprising:

an illumination system;

a housing, the housing self-containing a complete and independent illumination system, comprising:

an upper cover;

a lower cover, the lower cover attached to the upper cover; and a means for supporting the illumination system in close proximity to a striking surface of an associated percussion instrument, the means for supporting the illumination system configured to attach to a stand separate from, and in proximity to, the percussion instrument, a support structure for the percussion instrument, and a support frame of the percussion instrument;

wherein, when the illumination system is supported in close proximity to the striking surface of the percussion instrument, the illumination system is configured to activate after detecting a level of a percussion event produced by the percussion instrument selected from the group consisting of a vibration, a movement, and a sound.

2. The illumination system of claim 1, wherein the percussion instruments comprise at least one of a drum or a cymbal.

3. The illumination system of claim 2, wherein said means for supporting said illumination system is a clamp capable of attachment to the rim of said drum.

4. The illumination system of claim 2, wherein said means of supporting said illumination system is capable of threaded engagement with a support structure for said cymbal or a support frame associated with the rim of said drum.

5. The illumination system of claim 1, the illumination system further comprising one or more light sources controlled by one or more sensors, wherein said sensors and said light sources are self-contained within said housing, and wherein the light sources are adapted to illuminate the percussion instruments.

6. The illumination system of claim 5, wherein the light sources comprise lights of different colors.

7. The illumination system of claim 6, wherein each of said light source colors corresponds to a particular percussion instrument.

8. The illumination system of claim 5, wherein the one or more sensors are selected from the group consisting of vibration sensors, motion sensors, and sound sensors configured for activation when the percussion instruments are played.

9. The illumination system of claim 8, wherein the motion sensor is activated in response to movements produced by players of or sticks for the percussion instruments.

10. The illumination system of claim 8, wherein the sound sensor is activated in response to sounds produced by the percussion instruments.

11. The illumination system of claim 1, the illumination system further comprising a power source to operate the illumination system, wherein the power source comprises one or more battery cells.

12. The illumination system of claim 1, wherein a substrate is self-contained within said housing, and an inner surface of said lower cover is coated by reflection materials, and one or more sensors, one or more light sources, and one or more power sources are located on a substrate.

13. The illumination system of claim 12, wherein said system comprises a lens.

14. The illumination system of claim 1, wherein means for supporting said illumination system comprises a threaded attachment.

15. A method of controlling an illumination system for percussion instruments, the method comprising the steps of:

providing an illumination system for percussion instruments, the illumination system comprising:

a housing, the housing self-containing the complete and independent illumination system, comprising:

an upper cover;

a lower cover, the lower cover attached to the upper cover; and a means for supporting the illumination system in close proximity to a striking surface of an associated percussion instrument, the means for supporting the illumination system configured to attach to a stand separate from, and in proximity to, the percussion instruments, a support structure for the percussion instruments, and a support frame of the percussion instruments;

detecting vibrations, movements, or sounds produced by percussion instruments;

generating electrical signals representative of the detected vibrations, movements, or sounds, respectively;

illuminating a light by the generated electrical signals; and the electrical signals are different according to the level of detected vibrations, movements, or sounds, and the light is illuminated in different color and brightness according to the electrical signals, respectively.

16. The method of claim 15, wherein the illuminating time is dependent on the level of detected vibrations, movements, or sounds.

17. The method of claim 16, wherein the light comprises of a light-emitting diode.

18. A method of illuminating percussion instruments, the method comprising the steps of:

supporting an illumination device for percussion instruments in proximity to a striking surface of associated percussion instruments, the means for supporting the illumination system capable of being attached to a stand separate from and in proximity to the percussion instruments, a support structure for the percussion instruments, and a support frame of the percussion instruments; said illumination device comprising a housing, the housing self-containing a complete and independent illumination system and comprising:

an upper cover;

a lower cover, the lower cover attached to the upper cover; and a means for supporting the illumination system in close proximity to a striking surface of the percussion instrument, the means for supporting the illumination system capable of being attached to a stand separate from, and in proximity to, the percussion instruments, a support structure for the percussion instruments, and a support frame of the percussion instruments;

activating said illumination device to detect stimuli including vibrations, movements, or sounds produced by said percussion instruments;

producing said stimuli in connection with said percussion instruments; and illuminating percussion instruments by said illumination device in response to said stimuli.

* * * * *